US005125134A

United States Patent [19]

Morita

[11] Patent Number: 5,125,134

[45] Date of Patent: Jun. 30, 1992

[54] MAGNETIC FASTENER

[76] Inventor: Tamao Morita, 47-1 Arakawa 6-chome, Arakawa-ku, Tokyo, Japan

[21] Appl. No.: 657,257

[22] Filed: Feb. 19, 1991

Related U.S. Application Data

[63] Continuation of Ser. No. 478,755, Feb. 12, 1990, abandoned, which is a continuation of Ser. No. 188,631, May 2, 1988, abandoned, which is a continuation of Ser. No. 942,813, Dec. 17, 1986, abandoned.

[30] Foreign Application Priority Data

Dec. 27, 1985 [JP] Japan ..... 60-293173
Dec. 27, 1985 [JP] Japan ..... 60-293178

[51] Int. Cl.[5] ..... A44B 21/00
[52] U.S. Cl. ..... 24/303
[58] Field of Search ..... 24/303, 49 M, 667; 248/206.5; 292/251.5; 335/236, 285

[56] References Cited

U.S. PATENT DOCUMENTS

| | | | |
|---|---|---|---|
| 1,198,227 | 9/1916 | Hinchey . | |
| 2,340,781 | 2/1944 | Wagner . | |
| 2,397,931 | 4/1946 | Ellis . | |
| 2,475,226 | 7/1949 | Ellis . | |
| 2,521,885 | 9/1950 | Vasquez . | |
| 2,585,714 | 2/1952 | Wrobel et al. . | |
| 2,615,227 | 10/1952 | Hornik | 24/303 |
| 2,623,256 | 12/1951 | Feibelman . | |
| 2,627,423 | 2/1953 | Copeman . | |
| 2,693,654 | 11/1954 | Clark . | |
| 2,698,917 | 1/1955 | Van Ukr et al. . | |
| 2,726,110 | 12/1955 | Teetor . | |
| 2,784,757 | 3/1957 | Bosca et al. . | |
| 2,812,203 | 11/1957 | Scholten . | |
| 2,818,655 | 1/1958 | De Gaston . | |
| 2,826,328 | 3/1958 | Moen et al. . | |
| 2,884,698 | 5/1959 | Wursch . | |
| 2,901,278 | 8/1959 | Robinson . | |
| 2,915,681 | 12/1959 | Troy . | |
| 3,027,617 | 4/1962 | Gray | 24/303 |
| 3,038,232 | 6/1962 | Wean . | |
| 3,100,663 | 8/1963 | Loeb . | |
| 3,111,736 | 11/1963 | Budreck . | |
| 3,111,737 | 11/1963 | Heil . | |
| 3,141,216 | 7/1964 | Brett . | |
| 3,192,747 | 7/1965 | Stupell et al. . | |
| 3,223,898 | 12/1965 | Bey . | |
| 3,264,970 | 8/1966 | Hersh et al. . | |
| 3,269,608 | 8/1966 | Weber, III . | |
| 3,292,225 | 12/1966 | Burniski | 24/667 |
| 3,324,521 | 6/1967 | Humiston . | |
| 3,376,615 | 4/1968 | Heckman | 24/303 |
| 3,502,318 | 3/1970 | Merz . | |
| 3,509,734 | 5/1970 | Lederer . | |
| 3,618,174 | 11/1971 | Schainholz et al. . | |
| 3,722,360 | 3/1973 | Blakey et al. . | |
| 3,895,330 | 7/1975 | Yost . | |
| 3,897,288 | 7/1975 | Fayling . | |
| 3,919,743 | 11/1975 | Cutler | 24/303 |
| 4,021,891 | 5/1977 | Monta | 24/303 |
| 4,033,013 | 7/1977 | Peterson . | |
| 4,200,852 | 4/1980 | Aoki . | |
| 4,438,164 | 3/1984 | Pfeifer et al. . | |
| 4,455,719 | 6/1984 | Morita . | |
| 4,458,395 | 7/1984 | Aoki . | |
| 4,480,361 | 11/1984 | Morita | 24/303 |
| 4,593,736 | 6/1986 | Morita . | |

FOREIGN PATENT DOCUMENTS

| | | | |
|---|---|---|---|
| 1068149 | 10/1959 | Fed. Rep. of Germany . | |
| 1127509 | 4/1962 | Fed. Rep. of Germany . | |
| 1268582 | 6/1961 | France . | |
| 44-27953 | 11/1969 | Japan . | |
| 52-77900 | 6/1977 | Japan . | |
| 59-84402 | 5/1981 | Japan | 335/285 |
| 47-16817 | 10/1982 | Japan . | |
| 8045459 | 3/1964 | Switzerland . | |
| 2045335 | 10/1980 | United Kingdom | 24/303 |

*Primary Examiner*—James R. Brittain
*Attorney, Agent, or Firm*—Pennie & Edmonds

[57] ABSTRACT

A magnetic fastener has a female member comprised of a permanent magnet having an axial hole therethrough and a ferromagnetic plate on one pole surface thereof, and a male member comprising a ferromagnetic plate-shaped member removably engageable against the other pole face of the permanent magnet and having a projection extending therefrom insertable into the hole of the permanent magnet, the hole in the permanent magnet having an oblong or elongated shape having a longer diameter and a shorter diameter, the shorter diameter providing little or no clearance between the hole in the area of the shorter diameter and the projecting portion on the removable member, and the longer diameter being substantially greater than the diameter of the projection so that when the parts are separated for unfastening and attempt is made to incline or tilt the projection with respect to the central axis of the hole in the direction of the shorter diameter, the outer surface of the projecting portion will engage against the sidewalls of the hole and retard separation of the parts, but when the projecting portion is inclined or tilted in the direction of the larger diameter the projecting portion will not contact the sidewalls of the hole but can move freely therein, thus making it much easier to open the fastener in the direction of the larger diameter than in the direction of the smaller diameter.

8 Claims, 3 Drawing Sheets

MAGNETIC FASTENER

This application is a continuation of application Ser. No. 07/478,755, filed Feb. 12, 1990, abandoned, which is a continuation of application Ser. No. 07/188,631, filed May 2, 1988, abandoned, which is a continuation of application Ser. No. 06/942,813, filed Dec. 17, 1986, abandoned.

BACKGROUND OF THE INVENTION

The present invention relates to a fastener utilizing magnetic attraction wherein one member has of a permanent magnet which has a through-hole penetrating from one magnetic pole surface to the other magnetic pole surface and another member has a projection insertable into and attracted to the magnet.

Description of the Prior Art

Fasteners are known which comprise a female member made of ferromagnetic material attached on one magnetic pole surface of a permanent magnet and a male member made of ferromagnetic material magnetically attracted to the other magnetic pole surface thereof, wherein a projection of the male member is brought into contact or is attracted onto the ferromagnetic female member through a hole of the permanent magnet to thereby form an excellent magnetic closed circuit between the male and female members.

Various improvements have been made to magnetic fasteners utilizing magnetic force of a permanent magnet. The inventor has previously invented magnetic fastener means utilizing the magnetic force of a permanent magnet and magnetic pole plates 101, 102 attached respectively to N and S poles of the permanent magnet to converge the magnetic flux thereof at the pole plates for effecting contact between ferromagnetic projections provided on the pole plates respectively. Such improvements proposed have been published in U.S. Pat. Nos. 4,021,891 and No. 4,453,294.

The permanent magnet is made of a sintered material such as ferrite which is protected with a metal case because of its brittleness. The inventors U.S. patent application Ser. No. 836,537, filed Mar. 5, 1986, shows a further improvement on the fastener by using a permanent magnet made of synthetic resin to eliminate the use of heretofore needed case.

The most outstanding merit of Morita's improvements lies in that a hole is provided directed toward the direction of the N-S poles of the magnet so that the magnetic pole plate of a female fastener member and the plate of a male fastener member at the N-S poles respectively are contacted with the projections.

As a result, the magnetic flux of the permanent magnet is converged at the plates at the N and S poles. At the same time, a passage is constructed extending through the hole which is magnetically neutral. The passage extending between the two poles has less magnetic reluctance. By contacting the male member and the female member of the magnetic fastener in said passage, these two members are attracted strongly to each other.

In order to facilitate insertion of the projection of the male member of the fastener into the hole of the female member as well as engagement and disengagement of the fastener, the diameter of the hole is made sufficiently larger than the outer diameter of the projection of the male member so that the projection will not contact the inner walls of the hole even if the magnetic pole plate is inclined.

When leverage is applied on the contact face between the male member and the female member with a fulcrum at one end of the contact face, however, the magnetic attraction is easily broken by the separating force. For instance, if the leather used for the flap of a handbag is too thick or too hard, the flap attached on the rear side of a bag acts to exert leverage force when it is brought to the front side to be engaged by the fastener. This is caused by the force of flap trying to return from the folded state on the front side to the original unfolded state. The fastener may sometimes be subjected to a leverage force directed outward when the handbag is swelled because of too many contents. In such a case the magnetic pole plate of the male member is twisted off from the contact face on the permanent magnet, and the projection is inclined to be separated from the female magnetic pole plate to thereby unexpectedly and inconveniently open the bag.

BRIEF SUMMARY OF THE INVENTION

An object of this invention is to provide a fastener made of sintered magnets of, for example, ferrite or plastic magnet material which has a hole in a permanent magnet in oval form instead of circular form to have a longer diameter in one direction so that a projection made of ferromagnetic material can be more easily moved and inclined toward longitudinal direction than toward the direction of the shorter diameter. This makes the fastener easily detachable in the direction of the longer diameter, but harder to detach in the direction of the shorter diameter.

Another object of this invention is to form an excellent closed magnetic circuit between female and male members for strong magnetic attraction by causing a ferromagnetic male member to be magnetically attracted on a female member at a side thereof, the female member being constructed with a ferromagnetic member attached on a permanent magnet at the other side thereof, the permanent magnet having a hole extending from one magnetic pole surface to the other magnetic pole surface, and by magnetic attraction by a ferromagnetic projection on the ferromagnetic female member.

Still another object of this invention is to provide a fastener which is compact in size and is cheap to manufacture.

The above objects are achieved by this invention by the particular shape of the hole on the female member for insertion of the projection of the male member; more particularly by the improvement wherein the hole has an elongated shape having a longer diameter in one direction than the other direction perpendicular thereto instead of a circle.

As a result of the novel shape of the hole, the projection of the male member can be simply and easily taken out of the hole when tipped in the long diameter direction, and not easily removed in the direction of the shorter diameter and therefore the fastener of this invention would not become unexpectedly released even if the fastener is attached at a location where leverage is more likely to be applied on the engagement between the male and female members, e.g., a fastener for a bag.

BRIEF DESCRIPTION OF THE DRAWINGS

The invention will now be described in detail with reference to the accompanying drawings wherein.

DETAILED DESCRIPTION

The fastener according to this invention comprises a female member A made of a ferromagnetic material 2 attached on one magnetic pole surface a of a permanent magnet 1 having a through hole 1*a* which extends from one magnetic pole surface a to the other magnetic pole surface b and a male member B which is to be magnetically attracted onto the magnetic pole surface b of the female member A. A projection 3*a* an ferromagnetic member 3 of the male member B is attracted to a projection 2*a* protruding into hole 1*a* of the permanent magnet 1 from the plate surface of the ferromagnetic member 2 to thereby form a closed magnetic circuit between the female member A and the male member B for a powerful magnetic attachment.

Figure 1:
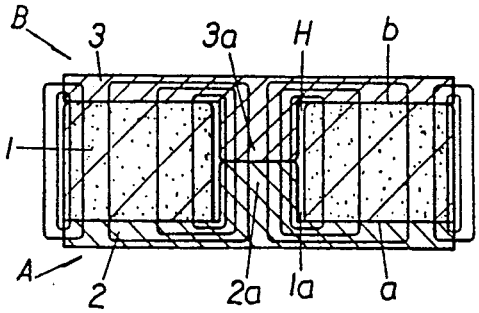
FIG. 1 is a cross sectional view of the invention which also illustrates schematically magnetic attraction.
Figure 2:
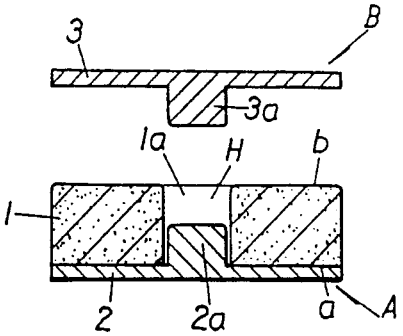
FIG. 2 is a view similar to FIG. 1 showing the parts separated.
Figure 3:
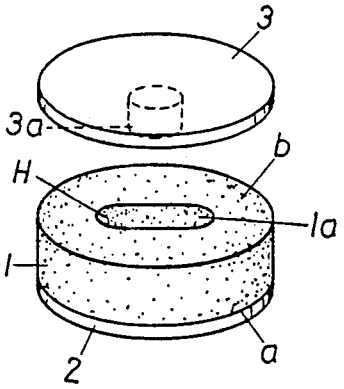
FIG. 3 is a perspective view of a magnetic fastener of the invention.
Figure 4:
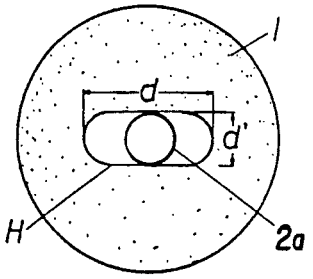
FIG. 4 is a top plan view of the female member of FIG. 3.
Figure 5:
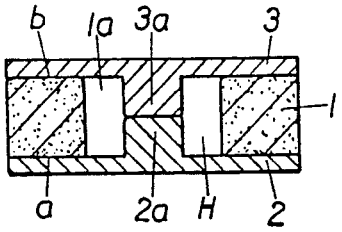
FIG. 5 is a cross-sectional view similar to FIG. 1, but at 90° thereto.

The hole 1*a* of the permanent magnet 1 has a slightly irregular oval shape H with one diameter d longer than the other diameter (see FIG. 4).

The magnetic flux of the permanent magnet 1 of the fastener having the aforementioned structure is converged to the ferromagnetic member 2 on one magnetic pole surface a and to the ferromagnetic member 3 on the other magnetic surface b. The magnetic flux is led to the projection 3*a* on the ferromagnetic member 3, or if a projection 2*a* is provided, to the projections 2*a* and 3*a* to form a circuit of the permanent magnet 1, the ferromagnetic member 3, the projection 3*a*, the ferromagnetic member 2, the permanent magnet 1, or a circuit of the permanent magnet 1, the ferromagnetic member 3 the the projection 3*a*, the projection 2*a*, the ferromagnetic member 2, and the permanent magnet 1 for strong magnetic attachment.

The hole 1*a* of the permanent magnet 1 has a diameter d which is longer than the diameter d' perpendicular to the diameter d. The diameter d' has a length approximate to the diameter of the projection 3*a*. If the male member B is inclined toward the direction of the shorter diameter, the projection 3*a* contacts against the inner walls of the hole 1*a* of the permanent magnet 1 and is made to return to the original position by magnetic force to secure the attachment between the male member B with the female member A.

Figure 24:
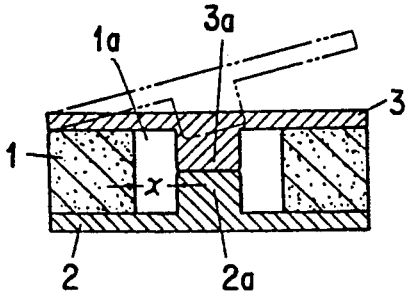
FIG. 24 is a view similar to FIG. 5 showing schematically the manner of opening the fastener.

When the male member B is inclined toward the direction of the longer diameter (see FIG. 24), the projection can be freely inclined to release the male member B from the attachment with the female member A.

As described in the foregoing, the magnetic flux of the permanent magnet 1 of the fastener is converged to the projection 3*a* to form a closed circuit thereby securing the magnetic attraction between the female member A and the male member B. This fastener achieves sufficient magnetic attraction even if it has only a small permanent magnet 1.

As this fastener can be attached on a bag with its shorter diameter of the hole 1*a* of the female member A parallel to the open/close direction of the flap of a bag, or on a necklace or a metal chain parallel to the direction in which tensile stress is applied, the engagement between the female member A and the male member B is reinforced even if the fastener is small having less magnetic force. This fastener can therefore be made smaller than prior art fasteners.

FIGS. 1 through 23 show embodiments of this invention. More particularly, FIGS. 1 through 5 show basic embodiments of this invention wherein the permanent magnet 1 may be a permanent magnet of ferrite, alnico or rare-earths, or of hard magnetic powder thereof with synthetic resin.

The female member A comprises permanent magnet 1 with a through hole 1*a* extending from one magnetic pole surface a to the other magnetic pole surface b, and a ferromagnetic member 2 in a plate form is attached on the magnetic pole surface a in a manner that a projection 2*a* protruding from the surface of the ferromagnetic member 2 is positioned approximately at the center of the hole 1*a*.

The male member B comprises a ferromagnetic member 3 in a plate form attracted on a magnetic pole surface b of the permanent magnet 1, and a projection 3*a* protruding from the ferromagnetic member 3 to contact with the projection 2*a* at the center of the hole 1*a*.

In the fastener having the aforementioned structure, magnetic lines of force are converged to the ferromagnetic member 2 on one magnetic pole surface a and to the ferromagnetic member 3 on the other magnetic pole surface b. Since the magnetic reluctance is low on the thick projections 2*a* and 3*a* of similar materials provided on the ferromagnetic members 2, 3, the magnetic lines of force are induced onto the projections to form a circuit of the permanent magnet 1, the ferromagnetic member 2, the projection 2*a*, the projection 3*a* and the ferromagnetic member 3.

The hole 1*a* of the permanent magnet 1 is shaped to be an oval hole H having a longer diameter d and a shorter diameter d' which is perpendicular to the diameter d and is approximately the same as the diameter of the projection 3*a* of the male member B.

Figure 6:
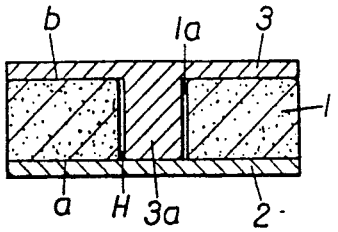
FIG. 6 is a cross-sectional view of another embodiment of the invention.

FIG. 6 shows an embodiment of a fastener which has no projection 2*a* of the famele member A, but has a projection 3*a* of the male member B which is made longer by the length equivalent to the projection 2*a* for direct connection to the ferromagnetic member 2.

Figure 7:
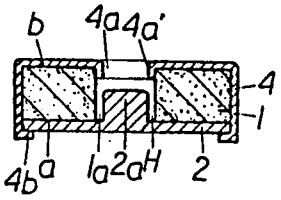
FIGS. 7 through 14 are cross-sectional views to illustrate additional embodiments of the female member.

FIGS. 7 through 14 show various embodiments of the combination between the permanent magnet 1 and ferromagnetic member 2. In FIGS. 7 through 10, the permanent magnet 1 and the ferromagnetic member 2 are integrally housed in a non-magnetic case 4 made of, for example, brass. The permanent magnet 1 in this case is a sintered magnet of ferrite or the like and is protected with the case 4 against brittleness. The hole 4*a* of the case 4 is shaped to correspond to the hole 1*a* of the permanent magnet 1 having a longer diameter in one direction and a shorter diameter in a direction perpendicular to the above. However, the hole 4*a* of the case 4 alone may be given the aforementioned oval shape and the hole of the permanent magnet 1 may be a simple circular cross-section having a diameter substantially the same as the larger diameter of hole 4a. FIG. 7 shows another structure wherein a permanent magnet 1 and a ferromagnetic member 2 attached on the magnetic pole surface a of the magnet 1 are housed within a case with the magnetic pole surface b at the inner side. The case 4 is shaped as a flat dome having a hole 4a communicating with the hole 1a of the magnet. The permanent magnet 1 and the ferromagnetic member 2 are secured in the case 4 with pawls 4b which are bent inward around the opening of the case 4. The reference numeral 4a' denotes a flange on the peripheral edge of the hole 4a.

Figure 8:
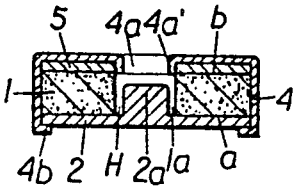
Figure 9:
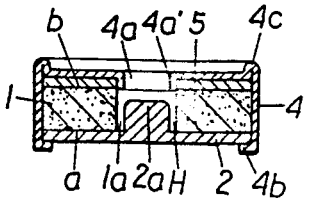

FIG. 8 shows another construction wherein a shielding plate 5 is interposed between a case 4 and a magnetic pole surface b so that the magnetic lines of force on the surface b are induced onto the shielding plate 5 without leaking to outside, so that when magnetic cards or magnetic tapes directly contact the case at the magnetic pole surface b, the magnetically recorded contents will not be disturbed. FIG. 9 shows still another structure wherein the outer peripheral edge of a case 4 on the side of the surface b is extended to form a flange 4c. The flange 4c has the following merits. As the permanent magnet has far more potent magnetic reluctance compared to the ferromagnetic plate, the magnetic lines of force are induced mainly on the larger surfaces a, b of the magnet 1, and the intensity of magnetic force becomes extremely small on the flange 4c. This prevents direct contact of magnetic cards or tapes with the case 4 on the side of the magnetic pole surface b. As the magnetic lines of force are weak on the flange 4c, magnetic recording in the tapes or cards will not be destroyed even if they contact the flange 4c. Another advantage of the structure is that the ferromagnetic plate 3 is prevented from moving laterally when secured within the flange 4c.

Figure 10:
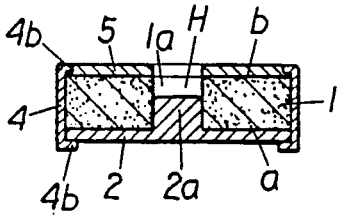
Figure 11:
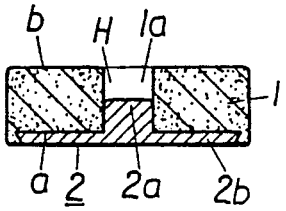

FIG. 10 shows still another construction wherein a case 4 is shaped like a short tube having pawls 4b, 4b at both openings to secure the members therein by bending the pawls inward over the ferromagnetic plate 2 attached on the magnetic pole surface a as well as on the magnetic shielding plate 5 attached on the magnetic pole surface b. The outer periphery of shielding plate 5 is notched to a depth which corresponds to the thickness of pawls 4b so that when they are bent inward, they will be flush with the plane of the shielding plate 5 to facilitate better magnetic attraction.

FIGS. 11 through 14 show embodiments of this invention made of a plastic permanent magnet 1. The magnet 1 may be made of hard magnetic powder of ferrite, alnico or rare-earths and synthetic resin.

The permanent magnet 1 may be formed by punching out a circular shape out of a sheet of material, but it is preferably made by molding the material in a metal die in order to achieve higher dimensional precision, or by attaching a ferromagnetic member which will be described hereinafter or by forming a skin layer thereon.

The permanent magnet 1 is made of hard magnetic powder bonded with synthetic resin and is formed with a skin layer on the surface.

The powder of the permanent magnet 1 is organically bonded with a resinous material, and yet retains a slightly resilient skin layer on the surface.

The permanent magnet 1 can have a higher impact strength and yet maintain a higher magnetic capacity. As the structure needs no case 4, the ferromagnetic member 2 may be molded together with the permanent magnet 1 in the same die or may be provided with a means to engage with the plate 2b of the ferromagnetic member 2 or may be bonded with an adhesive.

Figure 12:
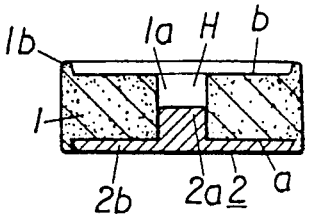
Figure 13:
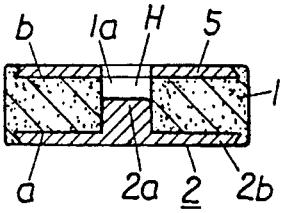
Figure 14:
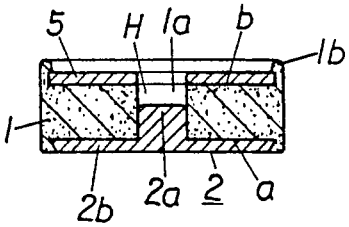

FIG. 12 shows a structure wherein the circumference of the permanent magnet projects upwardly at 1b on the side of the surface b. As the permanent magnet 1 is a plastic magnet, the edge thereof can easily be formed upward to form the edge 1b. FIG. 13 shows a construction wherein a ferromagnetic shielding plate 5 is embedded on the side of the surface b with one plate surface exposed; FIG. 14 shows another construction wherein the magnetic shield is reinforced by providing an edge 1b which is turned upward on the surface b as well as by embedding a magnetic shielding plate 5 in a manner similar to the above.

Figure 15:
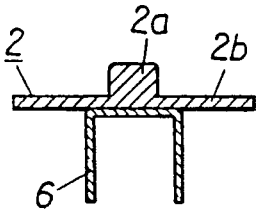
FIGS. 15 through 21 are cross sectional views of various embodiments of attaching legs.
Figure 16:
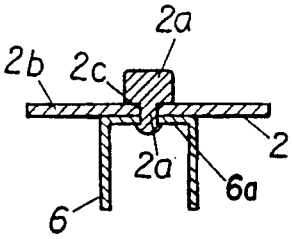

FIGS. 15 through 23 show embodiments of legs 6 of the female member A for attachment. FIG. 15 shows a construction wherein a ferromagnetic member 2 comprises an integrally molded projection 2a and a plate member and U-shaped a leg welded thereto. In FIG. 16, a plate member 2b and a projection 2a of the ferromagnetic member 2 are separately formed. A narrow rod 2a' of the projection 2a is inserted into a small hole 2c of the plate member 2b as well as into a small hole 6a of a leg 6 and then flattened to secure engagement. The leg 6 is inserted through the material fabric of a bag or the like, and the part of the leg 6 projecting from the fabric may be bent over a washer.

Figure 17:
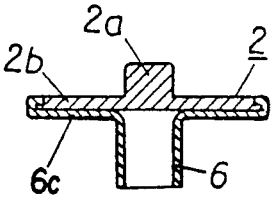
Figure 18:
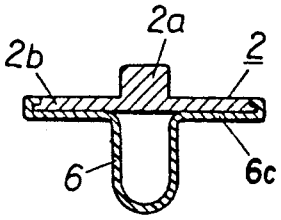
Figure 19:
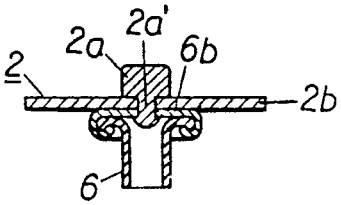
Figure 20:
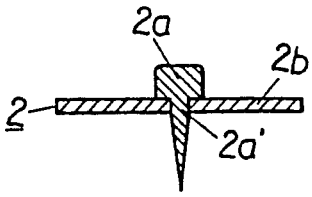
Figure 21:
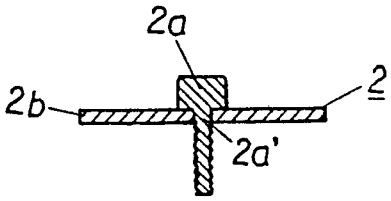

FIG. 17 shows a leg 6 of a pipe form which has a flange 6c at one end thereof and is attached to the periphery of the plate member 2b of the ferromagnetic member 2 in a pipe-like fashion. The leg 6 may be welded or brazed on the surface of the member 2b, and inserted through the material fabric of a bag. After insertion, the protruding part of the leg 6 is flattened like an eyelet with a washer interposed therebetween. FIG. 18 shows a modification of the leg 6 shown in FIG. 17 wherein the leg 6 forms a loop, or is closed, at one end. FIG. 19 shows a structure wherein a small rod 2a' of the projection 2a is inserted into a hole on a seat plate 6b and the end thereof is flattened. The structure may be attached onto the fabric in a manner similar to that shown in FIG. 17. In the structures shown in FIGS. 20, 21, a plate member 2b of the ferromagnetic member 2 and a projection 2a are separately made, and the narrow rod 2a' at the end of the projection 2a is respectively, a nail, a tack, and a wood screw or a bolt, so that in the latter form the female member A can be screwed into the material or the fabric. The leg 6 of the male member B has the structure similar to the above mentioned leg 6 for the female member A.

Figure 22:
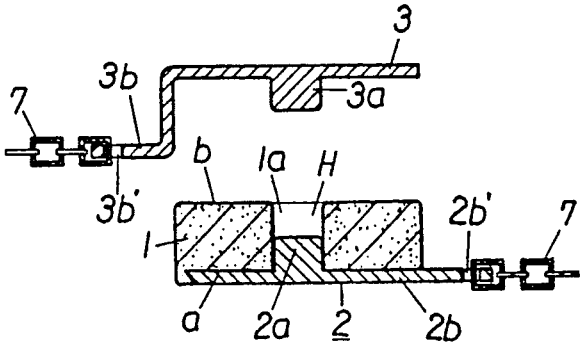
FIGS. 22 and 23 are cross-sectional views showing further embodiments of the fastener of this invention fastener.

FIG. 22 shows an embodiment applicable to a necklace, bracelet, or belt which has no legs but has attachment holes 2b', 3b' at one end of the respective plate members 2b, 3b of the ferromagnetic members 2, 3. Using the holes, the fastener can be connected to a chain 7 in a manner that the plate member 3b of the ferromagnetic member 3 is bent and the chains 7, 7 of the male B and female A members are arranged linearly.

Figure 23:
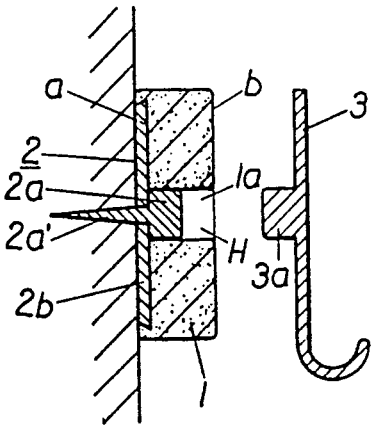

FIG. 23 shows an embodiment which can double as a hanger wherein the projection 2a of the ferromagnetic member 2 of the female member A has a small rod 2a' in a nail or wood screw form which can be driven or screwed into a wall or a post after inserting through the hole on the plate member 2b.

I claim:

1. In a magnetic fastener comprising:

an attraction member, said attraction member including a disc like permanent magnetic having a front pole face and a back pole face and a hole extending from said back pole face to said front pole face;

a first ferromagnetic plate fixedly attached to said back pole face;

an attracted member including a second ferromagnetic plate with a ferromagnetic projection of a predetermined shape fixedly attached thereto, said projection engages said second ferromagnetic plate through said hole and said second ferromagnetic plate contacts said front pole face when said attracted member is lockingly engaged to said attracting member, said projection acts as a flux linkage means for completing a magnetic circuit when said attracted member contacts against said attraction member, said magnetic circuit including said permanent magnet, said first ferromagnetic plate, said second ferromagnetic plate, and said ferromagnetic projection, the improvement wherein:

said hole has a first width which runs parallel to said front pole faced and a second width running perpendicular to said first width and running parallel to said front pole face, said first width being less than said second width, said second width being less than the diameter of the disc like magnet measured along the same direction as the second width, said first and second width being dimensioned so as to permit disengagement of the attracted member from the attraction member by tilting and pivoting the attracted member having said projection member about an axis parallel to said first width and perpendicular to said second width, while substantially constraining tilting and pivoting of the attracted member about an axis parallel to said second width.

2. A magnetic fastener according to claim 1, wherein said first width is dimensioned so that said first width restrains said projection from substantial tilting about an axis perpendicular to said first width, said second width being substantially larger than said first width so that as to enable said projection to be tilted about said axis which is parallel to said first width.

3. A magnetic fastener according to claim 2, wherein said second width is dimensioned so as to permit said projection member to slide along the second width direction within the bounds of said second width.

4. A magnetic fastener comprising:

an attraction member, said attraction member including a disc like permanent magnetic having a back pole face and a front pole face and a hole of a predetermined shape and size extending from a back pole face to a front pole face;

a first ferromagnetic plate fixedly attached to said back pole face; and an attracted member including a second ferromagnetic plate with a ferromagnetic projection of a predetermined shape and size, said projection acts as a flux linkage means for completing a magnetic circuit upon said projection contacting said first ferromagnetic plate and said second ferromagnetic plate contacting said front pole face, said magnetic circuit including said permanent magnet, said first ferromagnetic plate, said second ferromagnetic plate, and said ferromagnetic projection, said hole having a first width which runs parallel to said front pole faced and a second width running perpendicular to said first width and running parallel to said front pole face, said first width being less than said second width, said second width being less than the diameter of the disc like magnet measured along the same direction as the second width, said first and second width being dimensioned so as to permit dengagement of the attracted member from the attraction member by tilting and pivoting the attracted member having said projection member about an axis parallel to said first width and perpendicular to said second width, while substantially constraining tilting and pivoting of the attracted member about an axis parallel to said second width.

5. A magnetic fastener according to claim 4, wherein said first width is dimensioned so as to restrain said projection from substantial tilting about an axis perpendicular to said first width, said second width being substantially larger than said first width so as to enable said projection to be tilted about said axis which is parallel to said first width.

6. A magnetic fastener according to claim 4, wherein said second width is dimensioned so as to permit said projection member to slide along the second width direction within the bounds of said second width.

7. A magnetic fastener according to claim 4, wherein each of the said first and said second ferromagnetic plates are provided with an extension member having a hole.

8. A magnetic fastener according to claim 4, wherein said second ferromagnetic plate is provided with an extension member having a shape of a hook.

* * * * *